US010319295B2

(12) United States Patent
Yin

(10) Patent No.: US 10,319,295 B2
(45) Date of Patent: Jun. 11, 2019

(54) DRIVING APPARATUS, DRIVING METHOD AND DISPLAY APPARATUS

(71) Applicant: BOE Technology Group Co., Ltd., Beijing (CN)

(72) Inventor: Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 4 days.

(21) Appl. No.: 15/502,274

(22) PCT Filed: Jul. 4, 2016

(86) PCT No.: PCT/CN2016/088370
§ 371 (c)(1),
(2) Date: Feb. 7, 2017

(87) PCT Pub. No.: WO2017/113678
PCT Pub. Date: Jul. 6, 2017

(65) Prior Publication Data

US 2018/0068616 A1 Mar. 8, 2018

(30) Foreign Application Priority Data

Dec. 31, 2015 (CN) ..... 2015 1 1021518

(51) Int. Cl.
*G09G 3/3233* (2016.01)
*G09G 3/20* (2006.01)
*G09G 3/3291* (2016.01)

(52) U.S. Cl.
CPC ..... *G09G 3/3233* (2013.01); *G09G 3/2007* (2013.01); *G09G 3/2018* (2013.01);
(Continued)

(58) Field of Classification Search
CPC .. G09G 3/3233; G09G 3/3291; G09G 3/2007; G09G 3/2018; G09G 2300/0861;
(Continued)

(56) References Cited

U.S. PATENT DOCUMENTS

2004/0179005 A1 9/2004 Jo
2005/0017934 A1* 1/2005 Chung ..... G09G 3/3233 345/82
(Continued)

FOREIGN PATENT DOCUMENTS

CN 101140733 3/2008
CN 101727812 6/2010
(Continued)

OTHER PUBLICATIONS

International Search Report and Written Opinion of International Application No. PCT/CN2016/088370, dated Sep. 30, 2016.
(Continued)

*Primary Examiner* — Jose R Soto Lopez
(74) *Attorney, Agent, or Firm* — Westman, Champlin & Koehler, P.A.

(57) ABSTRACT

The present disclosure provides a driving apparatus for driving a light-emitting element. By dividing a light emission phase of the light-emitting element into at least two sub-phases, i.e., adding a dual-level level control signal, wherein one level causes the light-emitting element to emit light normally and the other level causes the light-emitting element to be turned off or operate under an extremely small current. By adjusting a duty ratio of the dual-level level control signal, a driving current of the light-emitting element during light emission can be adjusted to realize accurate control of the driving current of the light-emitting element.
(Continued)

The present disclosure further provides a driving method for the driving apparatus and a display apparatus including the driving apparatus.

19 Claims, 14 Drawing Sheets

(52) U.S. Cl.
CPC ... *G09G 3/3291* (2013.01); *G09G 2300/0819* (2013.01); *G09G 2300/0842* (2013.01); *G09G 2300/0861* (2013.01); *G09G 2300/0866* (2013.01); *G09G 2310/08* (2013.01); *G09G 2320/0247* (2013.01); *G09G 2320/045* (2013.01); *G09G 2320/064* (2013.01); *G09G 2330/021* (2013.01); *G09G 2330/028* (2013.01)

(58) Field of Classification Search
CPC ..... G09G 2300/0842; G09G 2330/028; G09G 2320/045; G09G 2320/0247; G09G 2330/021; G09G 2310/08; G09G 2300/0866; G09G 2320/064; G09G 2300/0819
See application file for complete search history.

(56) References Cited

U.S. PATENT DOCUMENTS

2006/0066253 A1* 3/2006 Kim ..... G09G 3/3233 315/169.3
2006/0066532 A1* 3/2006 Jeong ..... G09G 3/3233 345/76
2007/0040770 A1* 2/2007 Kim ..... G09G 3/3233 345/76
2008/0169460 A1* 7/2008 Yoo ..... G09G 3/3233 257/40
2008/0180365 A1* 7/2008 Ozaki ..... G09G 3/3233 345/76
2008/0211747 A1* 9/2008 Kim ..... G09G 3/3233 345/76
2009/0027310 A1* 1/2009 Kim ..... G09G 3/3233 345/76
2009/0179839 A1 7/2009 Yamashita et al.
2010/0013816 A1* 1/2010 Kwak ..... G09G 3/3233 345/211
2010/0103162 A1* 4/2010 Yamashita ..... G09G 3/3233 345/213
2010/0177125 A1* 7/2010 Miwa ..... G09G 3/3233 345/690
2011/0063266 A1* 3/2011 Chung ..... G09G 3/3233 345/205
2011/0069058 A1* 3/2011 Chung ..... G09G 3/3233 345/212
2011/0084947 A1* 4/2011 Chung ..... G09G 3/3233 345/211
2011/0109531 A1* 5/2011 Choi ..... G09G 3/3233 345/76
2011/0141000 A1* 6/2011 Han ..... G09G 3/3233 345/82
2011/0175881 A1* 7/2011 Kim ..... G09G 3/3225 345/211
2011/0267319 A1* 11/2011 Han ..... G09G 3/3233 345/204
2011/0279484 A1* 11/2011 Han ..... G09G 3/3233 345/690
2012/0001896 A1* 1/2012 Han ..... G09G 3/3233 345/214
2012/0019498 A1* 1/2012 Jeong ..... G09G 3/3233 345/211
2012/0019501 A1* 1/2012 Choi ..... G09G 3/3233 345/211
2012/0038683 A1* 2/2012 Park ..... G09G 3/3233 345/690
2012/0146979 A1* 6/2012 Kim ..... G09G 3/3233 345/211
2012/0162176 A1* 6/2012 Kim ..... G09G 3/3258 345/211
2013/0140537 A1* 6/2013 Ha ..... H01L 27/3262 257/40
2014/0022150 A1 1/2014 Guo et al.
2014/0027719 A1* 1/2014 Kim ..... H05B 33/0896 257/40
2017/0047012 A1* 2/2017 Maeyama ..... G09G 3/30
2017/0269783 A1 9/2017 Yang et al.

FOREIGN PATENT DOCUMENTS

CN 105139804 A 12/2015
CN 105609053 5/2016
CN 205282059 6/2016
JP 2008026762 A 2/2008
JP 2010048985 A 3/2010
KR 10-2014-0116702 10/2014

OTHER PUBLICATIONS

English translation of Box No. V of the Written Opinion for the International Searching Authority for International Application No. PCT/CN2016/088370.
Extended European Search Report for European Patent Application No. 16831883.0, dated Apr. 17, 2018, 11 pages.

* cited by examiner

DRIVING APPARATUS, DRIVING METHOD AND DISPLAY APPARATUS

CROSS-REFERENCE TO RELATED APPLICATION

This application is a Section 371 National Stage Application of International Application No. PCT/CN2016/088370, filed on Jul. 4, 2016 which claims priority to the Chinese Patent Application No. 201511021518.4, filed on Dec. 31, 2015, entitled "DRIVING APPARATUS, DRIVING METHOD AND DISPLAY APPARATUS" which is incorporated herein by reference in its entirety.

TECHNICAL FIELD

The present disclosure relates to the display technology, and more particularly, to a driving apparatus, a driving method, and a display apparatus, which can control turn-on/turn-off of a light-emitting element using a multi-level control signal, to enhance accuracy of a driving current, thereby improving display quality.

BACKGROUND

Active Matrix Organic Light Emitting Diodes (AMOLEDs) are one of the hot spots in the research field of today's flat panel displays. Compared with Liquid Crystal Displays (LCDs), Organic Light Emitting Diodes (OLEDs) have advantages such as low power consumption, a low production cost, self-luminosity, a wide angle of view and a fast response etc. At present, in the display field such as mobile phones, Personal Digital Assistants (PDAs), digital cameras etc., the conventional LCD display screens have began to be replaced by OLED display screens. Pixel driving is the core technical content for AMOLED displays, and has important research significance.

Unlike Thin Film Transistor-Liquid Crystal Displays (TFT-LCDs) that use a stable voltage to control luminance, the OLEDs are driven by a current and require a constant current to control light emission. As shown in FIG. 1, a pixel driving circuit of the conventional AMOLED uses a 2T1C pixel driving circuit. The circuit is only comprised of one Driving Thin Film Transistor (DTFT), a switch thin film transistor T1 and a storage capacitor C. An OLED and the DTFT are connected in series to a driving power supply voltage ELVDD, and a gate of the DTFT is connected to a data line which provides a data signal Vdata through the switch thin film transistor T1. A scanning line is connected to a gate of the switch thin film transistor T1 to gate a row. FIG. 2 illustrates an operation timing diagram of the pixel driving circuit shown in FIG. 1, which shows a timing relationship between a scanning signal provided by the scanning line and a data signal provided by the data line.

When the scanning line gates (i.e., scans) a certain row, in phase t1, the scanning signal Gate(n) is a low level signal, T1 is turned on, and the data signal $V_{data}$ is written into the storage capacitor C. After the row is completely scanned, in phase t2, Gate(n) transitions to a high level signal, T1 is turned off, and a gate voltage stored on the storage capacitor C drives the DTFT to generate a current which drives the OLED to emit light.

According to the characteristics of the DTFT, a current passing through the DTFT is $$I_D = \frac{1}{2}\mu C_{OX}\frac{W}{L}(V_{GS} - V_{TH})^2,$$

where $V_{GS}$ is a gate-source voltage of the DTFT, $V_{TH}$ is a threshold voltage of the DTFT, $C_{OX}$ is a capacitance of an oxide layer of the DTFT, W and L are a channel width and a channel length of the DTFT respectively, μ is a mobility, and $V_{GS}=V_{data}-ELV_{DD}$. By substituting $V_{GS}$ into the above equation, $$I_D = \frac{1}{2}\mu_n C_{OX}\frac{W}{L}(V_{data} - ELV_{DD} - V_{TH})^2$$

is derived. Therefore, in the driving circuit of the OLED, the driving current and the data signal $V_{data}$ outputted by the source driving circuit are in a quadratic function relationship.

FIG. 3 illustrates a relationship between a driving current and luminance of an organic light emitting diode. As can be seen from FIG. 3, the luminance of the organic light emitting diode increases as a current density increases, and becomes darker as the current density decreases.

For an OLED display with certain luminance, a current range provided to the OLED is determined. As shown in FIG. 3, when a display in a luminance range of 0~20000 cd/m$^2$ uses an EFF50 EL material, a driving current range is 0~37 mA/cm$^2$, and when the display uses an EFF80 EL material with higher efficiency, only 0~24 mA/cm$^2$ is required. Thus, as the efficiency of the material increases, it is required to reduce the driving current, which reduces power consumption while requiring improved accuracy of the driving current under the same grayscale (8 bits correspond to 256 grayscales).

As can be known from the driving current $$I_D = \frac{1}{2}\mu_n C_{OX}\frac{W}{L}(V_{data} - ELV_{DD} - V_{TH})^2$$

of the DTFT, when the driving current range decreases, if an W/L ratio of the DTFT does not change, it is required to reduce a voltage range of $V_{data}$, which requires improved accuracy of a voltage $V_{data}$ output by a source driving circuit. The accuracy of the voltage output by the source driving circuit can now achieve 5 mV/grayscale. If the efficiency is then doubled, it needs to achieve 3 mV/grayscale, which has exceeded the process capability of the source driving circuit. Of course, the accuracy of $V_{data}$ may also be reduced by reducing the W/L value of the DTFT. However, with the increase of resolution, in a limited pixel space, it is difficult to further increase the channel length of the DTFT.

Therefore, there is a need for an apparatus and method which can improve the accuracy of the driving current and thereby improve the display quality.

SUMMARY

The present disclosure proposes a driving apparatus, a driving method, and a display apparatus, which can divide a light emission phase of the light-emitting element into at least two sub-phases, i.e., providing a dual-level driving in the light emission phase of the light-emitting element, wherein one level enables the light-emitting element to emit light normally, and the other level enables the light-emitting element not to emit light. In a case that the luminance is maintained to be unchanged, the driving current of the light-emitting element during light emission is enhanced by reducing a duty ratio between two levels, so as to improve the accuracy of the driving current.

According to a first aspect of the present disclosure, there is provided a driving apparatus for driving a light-emitting element, comprising:

a source driving circuit configured to generate a row scanning signal required for driving the light-emitting element and a data signal, wherein the data signal is written into a driving control circuit for the light-emitting element when the row scanning signal is valid; the driving control circuit configured to write a parameter of a driving element for the light-emitting element while writing the data signal when the row scanning signal is valid, wherein the driving control circuit is further configured to receive a level control signal and provide a driving voltage to the driving element according to the data signal, the parameter of the driving element and the level control signal in a light emission phase of the light-emitting element; and the driving element configured to convert the driving voltage provided by the driving control circuit into a driving current, and provide the driving current to the light-emitting element, so that the light-emitting element emits light under the driving of the driving current provided by the driving element; wherein the level control signal is configured to comprise a high level and a low level, one of which causes the driving voltage not to be sufficient enough to drive the driving element, and the other of which causes the driving control circuit to provide the driving voltage to the driving element according to the data signal and the parameter of the driving element to cause the light-emitting element to emit light.

Preferably, the level control signal is a power supply signal of the light-emitting element, wherein when the level control signal is at a high level, the driving control circuit provides the driving voltage to the driving element according to the data signal and the parameter of the driving element to drive the light-emitting element to emit light by the driving element, and when the level control signal is at a low level, the provided driving voltage is unable to drive the driving element and thereby the light-emitting element does not emit light.

Preferably, a high level power supply signal and a low level power supply signal are generated by a voltage selector, wherein the voltage selector comprises a high level voltage power supply for outputting the high level power supply signal and a low level voltage power supply for outputting the low level power supply signal, and the voltage selector receives a selection signal, and selects output of a power supply signal at one of a high level and a low level according to the selection signal.

Preferably, one of the high level power supply signal and the low level power supply signal is set as a power supply signal for causing the light-emitting element to emit light normally, and when the other of the high level power supply signal and the low level power supply signal is set as a power supply signal and the power supply signal is applied, driving elements are all in a cut-off state under all the data signals.

Preferably, the selection signal is generated by the source driving circuit or an external circuit.

Preferably, the voltage selector is comprised in the source driving circuit.

Preferably, the level control signal is input to a control terminal of the driving element, wherein the level control signal at one of the high level and the low level causes the driving element to be driven normally, and the level control signal at the other of the high level and the low level causes the driving element to be in a cut-off state or in a slight turn-on state.

Preferably, the level control signal is generated by the source driving circuit or an external circuit.

Preferably, the level control signal is synchronous with the row scanning signal.

Preferably, a duty ratio between the high level and the low level of the level control signal is adjustable.

Preferably, the voltage selector comprises a first transistor having a gate configured to receive the selection signal of the driving voltage control circuit, a source configured to receive a high level power supply signal, and a drain connected to a gate of a second transistor; the second transistor having a source configured to receive the high level power supply signal, and a drain connected to an output terminal; a first resistor having one end connected to the gate of the second transistor and the other end connected to the ground; a third transistor having a gate connected to a source of a fourth transistor, a source configured to receive a low level power supply signal, and a drain connected to the output end; the fourth transistor having a gate configured to receive the selection signal of the driving voltage control circuit and a drain connected to the ground; and a second resistor having one end connected to the source of the third transistor and the other end connected to the gate of the third transistor.

According to a second aspect of the present disclosure, there is provided a method for driving a light-emitting element applied in the driving apparatus according to the present disclosure, comprising: providing a row scanning signal on a row scanning line; providing a data signal on a data line; providing a level control signal; writing a parameter of a driving element for the light-emitting element into a driving control circuit while writing the data signal when the row scanning signal is valid; and providing a driving voltage to the driving element according to the data signal, the parameter of the driving element and the level control signal in a light emission phase of the light-emitting element; wherein the level control signal is configured to comprise a high level and a low level, one of which causes the driving voltage not to be sufficient enough to drive the driving element, and the other of which causes the driving voltage to be provided to the driving element according to the data signal and the parameter of the driving element to cause the light-emitting element to emit light.

Preferably, the level control signal is a power supply signal of the light-emitting element.

Preferably, the level control signal is applied to a control terminal of the driving element, wherein the level control signal at one of the high level and the low level causes the driving element to be driven normally, and the level control signal at the other of the high level and the low level causes the driving element to be in a cut-off state or in a slight turn-on state.

Preferably, the level control signal is synchronous with the row scanning signal.

According to a third aspect of the present disclosure, there is provided a display apparatus, comprising: the driving apparatus according to the present disclosure; and light-emitting elements each configured to emit light according to the driving current provided by the driving apparatus.

BRIEF DESCRIPTION OF THE DRAWINGS

The above and other purposes, features and advantages of the present disclosure will be more clear with illustration of preferable embodiments of the present disclosure in conjunction with the accompanying drawings, in which.

DETAILED DESCRIPTION

Exemplary embodiments of the present disclosure will be described in detail below with reference to the accompanying drawings. In the following description, some specific embodiments are merely provided for the purpose of description and should not be construed as limiting the present disclosure, but are merely examples of the present disclosure. Conventional structures or configurations will be omitted when the understanding of the present disclosure may be confused.

Figure 1:
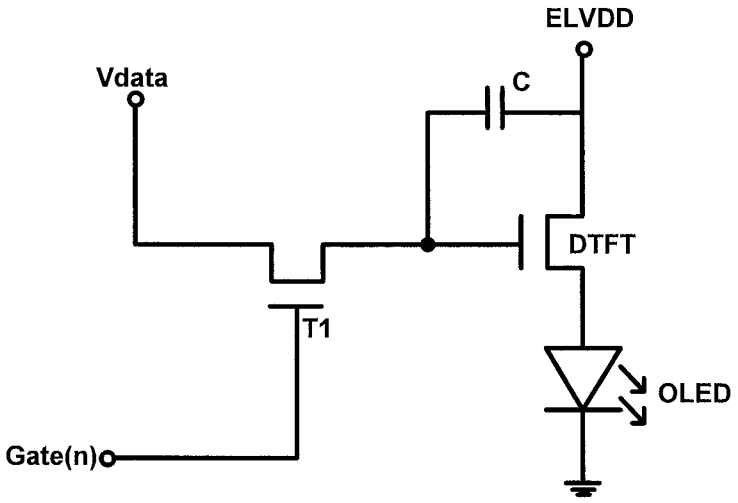
FIG. 1 is a structural diagram of a pixel driving circuit in the prior art.
Figure 2:
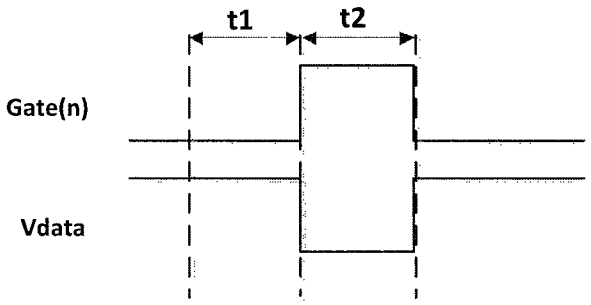
FIG. 2 is an operation timing diagram of a pixel driving circuit in the prior art.
Figure 3:
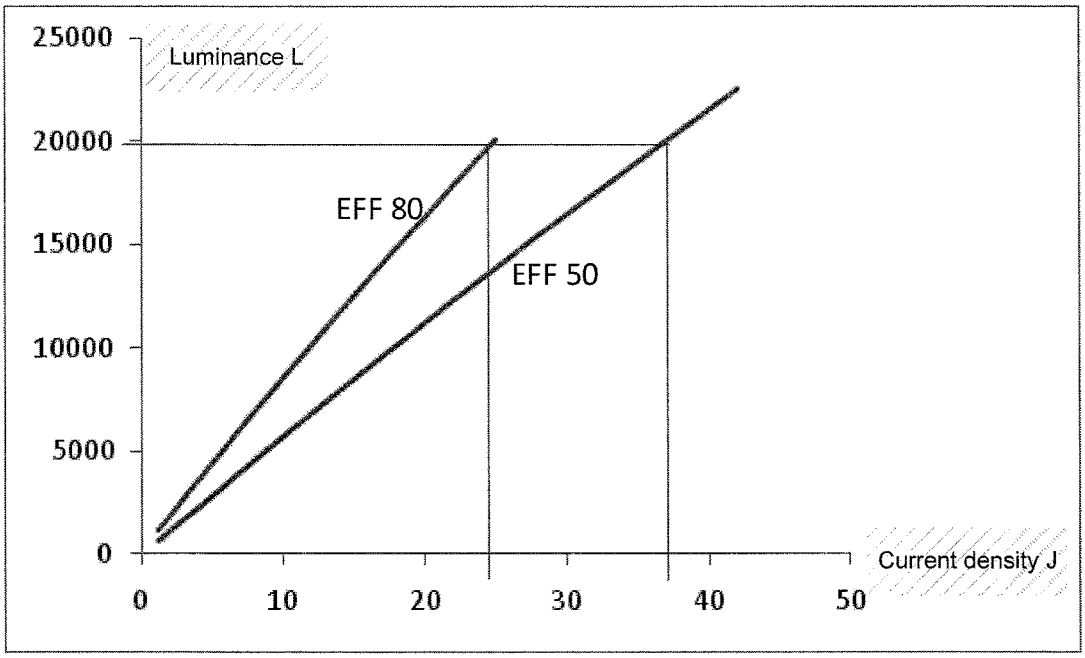
FIG. 3 is a diagram of a relationship between a driving current and luminance of an OLED.
Figure 4:
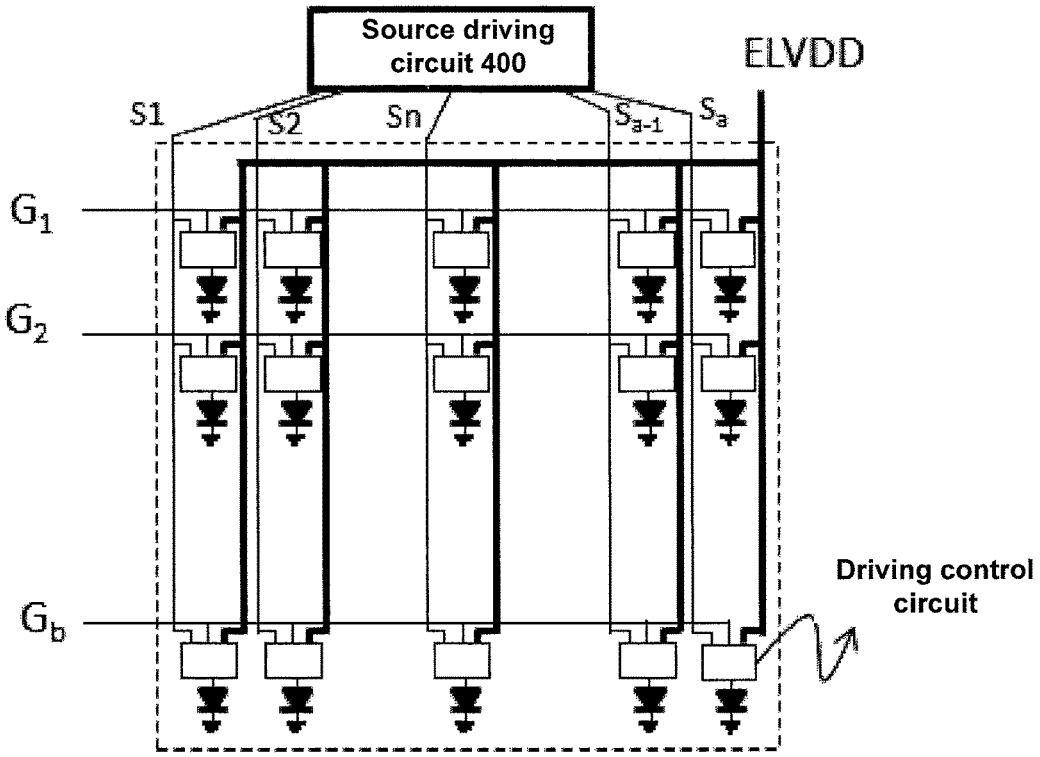
FIG. 4 is a structural diagram of a conventional display apparatus.

FIG. 4 is a structural diagram of a conventional display apparatus. As shown in FIG. 4, the display apparatus comprises a source driving circuit 400, driving control circuits, driving elements, and light-emitting elements arranged in b rows*a columns. The source driving circuit 400 provides row scanning signals G1-Gb and provides data signals S1-Sa. It is to be noted that, although it is only illustrated in FIG. 4 that the source driving circuit provides the data signals S1-Sa, the source driving circuit also provides the scanning signals G1-Gb. This is also applicable to the illustrations shown below. For an 8-bit display, $2^8$=256 grayscale voltages may be provided. For a 10-bit display, $2^{10}$=1024 grayscale voltages are required to be provided. $ELV_{DD}$ represents a voltage of a power supply signal.

Figure 5:
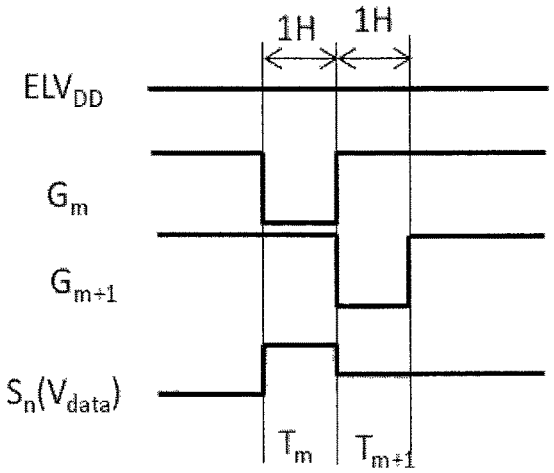
FIG. 5 is an operation timing diagram of a driving apparatus in a conventional display apparatus.

FIG. 5 is an operation timing diagram of a driving apparatus in a conventional display apparatus. Here, PMOS transistors will be described as an example. That is, a low level is a valid level. When an $m^{th}$ row of scanning signal Gm is at a low level, the entire $m^{th}$ row of light-emitting elements are selected, in which case a data signals S1-Sa are written into driving control circuits for the $m^{th}$ row of a light-emitting elements respectively. When the $m^{th}$ row of scanning signal ends, an $(m+1)^{th}$ row is turned on, and similarly, a data signals S1-Sa are written into the driving control circuits for the $(m+1)^{th}$ row of a light-emitting elements respectively, and so on. After the $m^{th}$ row of data signals are written into corresponding driving control circuits, each of the driving control circuits provides a driving voltage corresponding to a respective data signal to a corresponding driving element, and the driving element converts the driving voltage into a driving current to drive a corresponding light-emitting element. In general, $ELV_{DD}$ is a constant voltage.

Figure 6:
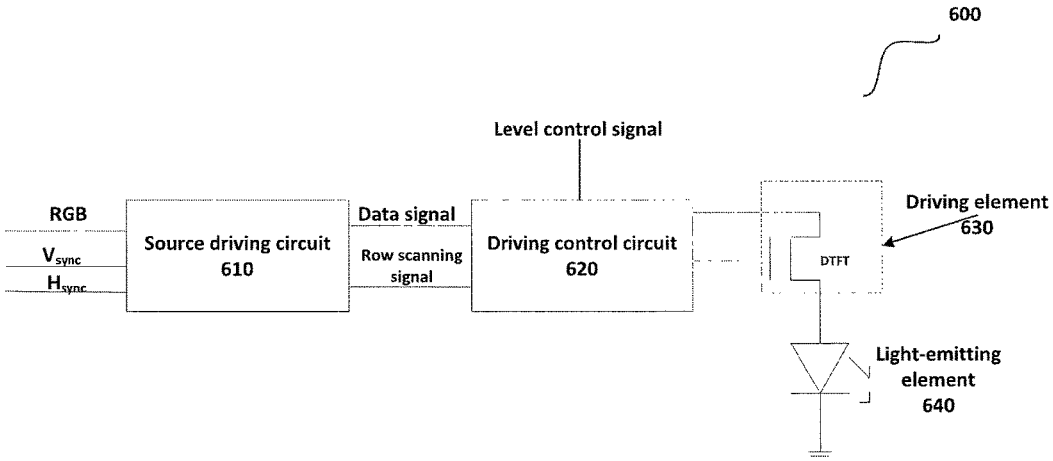
FIG. 6 is a structural diagram of a driving apparatus according to an embodiment of the present disclosure.

FIG. 6 is a structural diagram of a driving apparatus 600 according to an embodiment of the present disclosure.

As shown in FIG. 6, according to the embodiment of the present disclosure, the driving apparatus 600 comprises: a source driving circuit 610 configured to generate a row scanning signal and a data signal according to an input video signal; a driving control circuit 620 configured to write a parameter of a driving element for a light-emitting element while writing the data signal when the row scanning signal is valid, wherein the driving control circuit is further configured to receive a level control signal and generate a driving voltage according to the row scanning signal, the data signal and the level control signal of the source driving circuit in a light emission phase of the light-emitting element; and the driving element 630 configured to convert the driving voltage provided by the driving control circuit into a driving current. FIG. 6 further illustrates the light-emitting element 640, configured to emit light according to the driving current provided by the driving apparatus 600, specifically, the driving current provided by the driving element 630. The level control signal is configured to comprise a high level and a low level, one of which causes the driving voltage not to be sufficient enough to drive the driving element, and the other of which causes the driving control circuit to provide the driving voltage to the driving element according to the data signal and a parameter of the driving element, wherein the driving voltage can compensate for the parameter of the driving element and cause the light-emitting element to emit light normally.

Figure 7:
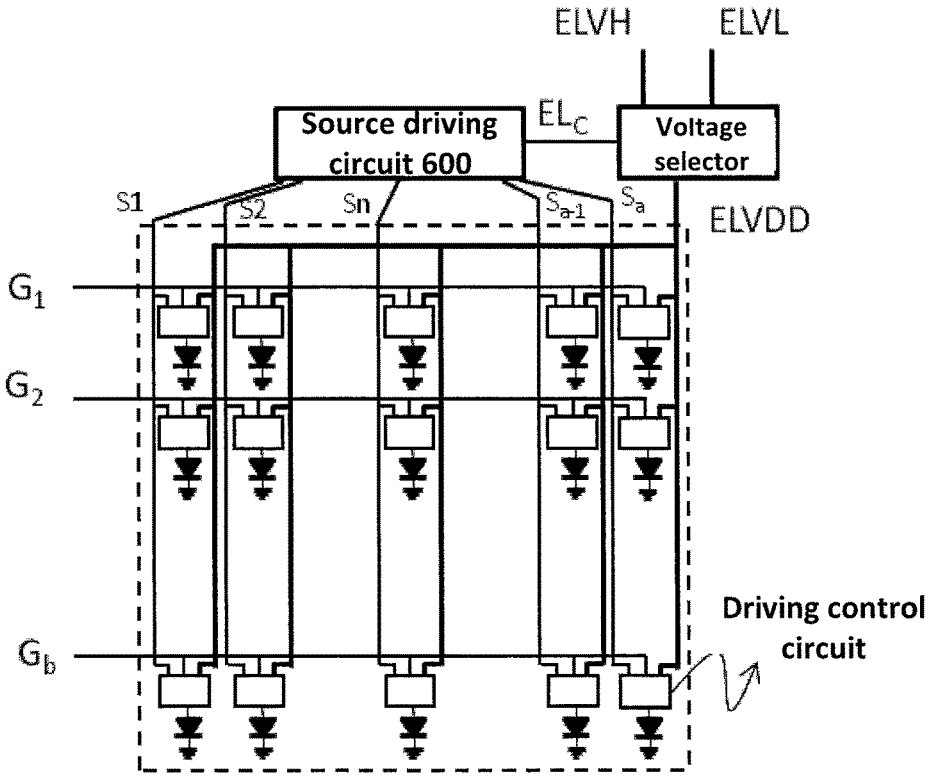
FIG. 7 is a structural diagram of a display apparatus according to an embodiment of the present disclosure.
Figure 8:
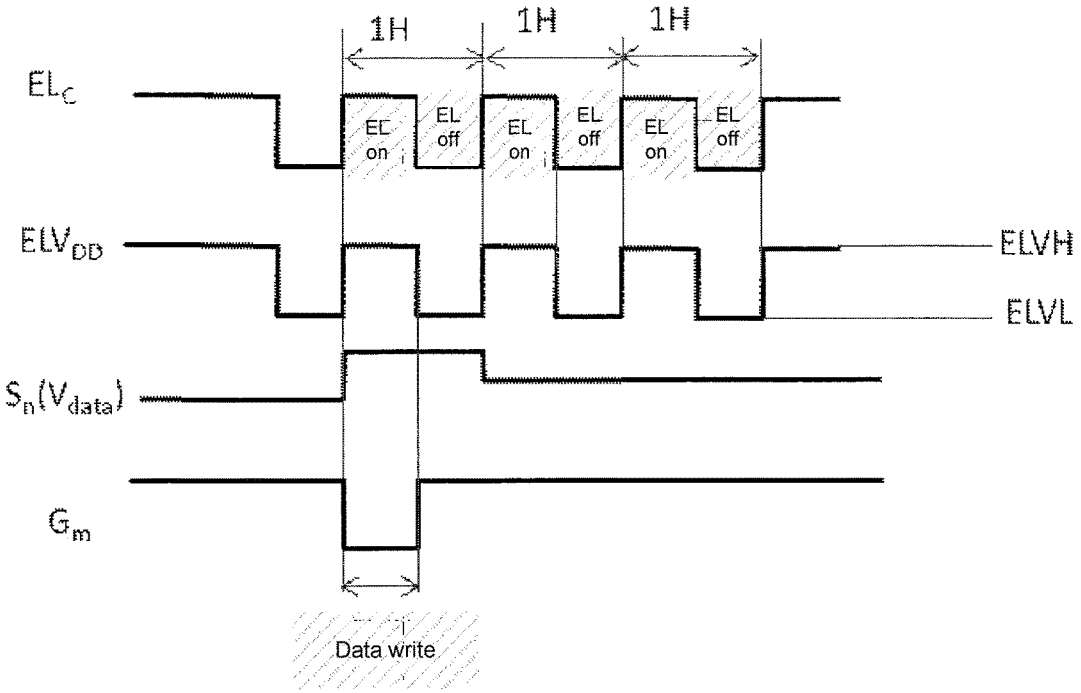
FIG. 8 is an operation timing diagram of a driving apparatus in a display apparatus according to an embodiment of the present disclosure.

FIG. 7 is a structural diagram of a display apparatus according to an embodiment of the present disclosure. The display apparatus shown in FIG. 7 uses the driving apparatus 600 according to the embodiment of the present disclosure shown in FIG. 6. FIG. 8 is an operation timing diagram of a driving apparatus in a display apparatus according to an embodiment of the present disclosure.

As shown in FIG. 7, a high level voltage ELVH and a low level voltage ELVL are provided to the display apparatus, and a voltage selector is provided to the display apparatus. That is, the level control signal is a power supply signal of the light-emitting element.

As shown in FIG. 7, the voltage selector receives a dual-level signal, i.e., a high level power supply signal and a low level power supply signal. The source driving circuit 600 outputs a selection signal $EL_C$ to the voltage selector, to cause the voltage selector to selectively output one of the high level power supply signal and the low level power supply signal. When the level control signal is the high level power supply signal, the driving control circuit provides the driving voltage to the driving element according to the data signal and the parameter of the driving element to drive the light-emitting element to emit light by the driving element, and when the level control signal is the low level power supply signal, the provided driving voltage is unable to drive the driving element and thereby the light-emitting element does not emit light.

As shown in FIG. 8, the selection signal $EL_C$ outputted by the source driving circuit is a pulse control signal having a duty ratio of D. This pulse has the same period as a period of the row scanning signal of the display apparatus, and is divided into a high level and a low level within the period of the row scanning signal, so that the voltage $ELV_{DD}$ of the power supply signal output by the voltage selector is also correspondingly divided into a high level and a low level, which represent a light emission sub-phase and a non-light emission sub-phase of the light-emitting element, respectively.

When the voltage $ELV_{DD}$ of the provided power supply signal is alternatively at a high level and a low level, the data signal cannot be written when the voltage of the power supply signal is at a low level since the signal written at this time is no longer a data voltage corresponding to the data signal. As a result, the row scanning signal Gm is correspondingly adjusted so that a gating time thereof is the same as duration of the high level power supply signal. That is, the level control signal is synchronous with the row scanning signal. The duty ratio between the high level and the low level of $EL_C$ may be correspondingly adjusted to achieve a desired driving current density. However, a minimum duty ratio of $EL_C$ needs to ensure a data write time.

According to an embodiment of the present disclosure, the voltage selector is provided outside the source driving circuit. According to another embodiment, the voltage selector may be included in the source driving circuit. The voltage selector comprises a high level voltage power supply for outputting a high level power supply signal and a low level voltage power supply for outputting a low level power supply signal. According to an embodiment, the selection signal $EL_C$ is generated by the source driving circuit or an external circuit.

Figure 9:
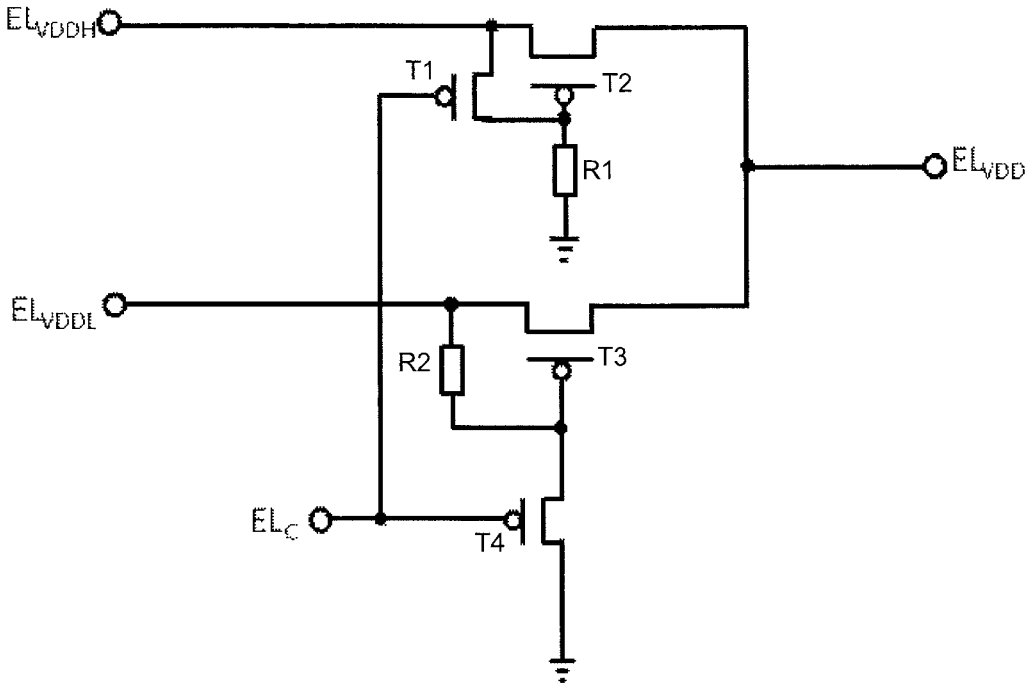
FIG. 9 illustrates a diagram of a voltage selector according to an embodiment of the present disclosure.

FIG. 9 illustrates a diagram of a voltage selector according to an embodiment of the present disclosure. As shown in FIG. 9, the voltage selector 900 comprises a first transistor T1 having a gate configured to receive a selection signal of the driving voltage control circuit, a source configured to receive the high level power supply signal, and a drain connected to a gate of a second transistor T2; the second transistor T2 having a source configured to receive the high level power supply signal, and a drain connected to an output terminal; a first resistor R1 having one end connected to the gate of the second transistor T2 and the other end connected to the ground; a third transistor T3 having a gate connected to a source of a fourth transistor T4, a source configured to receive the low level power supply signal, and a drain connected to the output end; the fourth transistor T4 having a gate configured to receive the selection signal of the driving voltage control circuit and a drain connected to the ground; and a second resistor R2 having one end connected to the source of the third transistor T3 and the other end connected to the gate of the third transistor T3.

When the selection signal $EL_C$ selects the high level signal $EL_{VDDH}$, the transistors T1 and T4 are turned on, T3 is turned off, and T2 is turned on. Therefore, the voltage $EL_{VDD}$ of the output power supply signal is equal to $EL_{VDDH}$ minus a turn-on voltage of T1, and as a result, the output voltage is a power supply signal which is approximately equal to $EL_{VDDH}$. When the selection signal $EL_C$ selects the low level signal $EL_{VDDL}$, T1 and T4 are turned off, T2 is turned off, and T3 is turned on. The voltage $EL_{VDD}$ of the output power supply signal is equal to $EL_{VDDL}$ minus a turn-on voltage of T3, and as a result, the output voltage is a power supply signal which is approximately equal to $EL_{VDDL}$. Therefore, the high level power supply signal and low level power supply signal can be selectively output by controlling the selection signal $EL_C$.

Obviously, in the voltage selector illustrated in FIG. 9, PMOS transistors will be described as an example. However, it is to be noted that NMOS transistors or other transistors, or even other connection manners, may be used as well, as long as the high level signal $EL_{VDDH}$ and the low level signal $EL_{VDDL}$ are input, and the output power supply signal selectively outputs a high level power supply signal and a low level power supply signal according to the selection signal.

Figure 10:
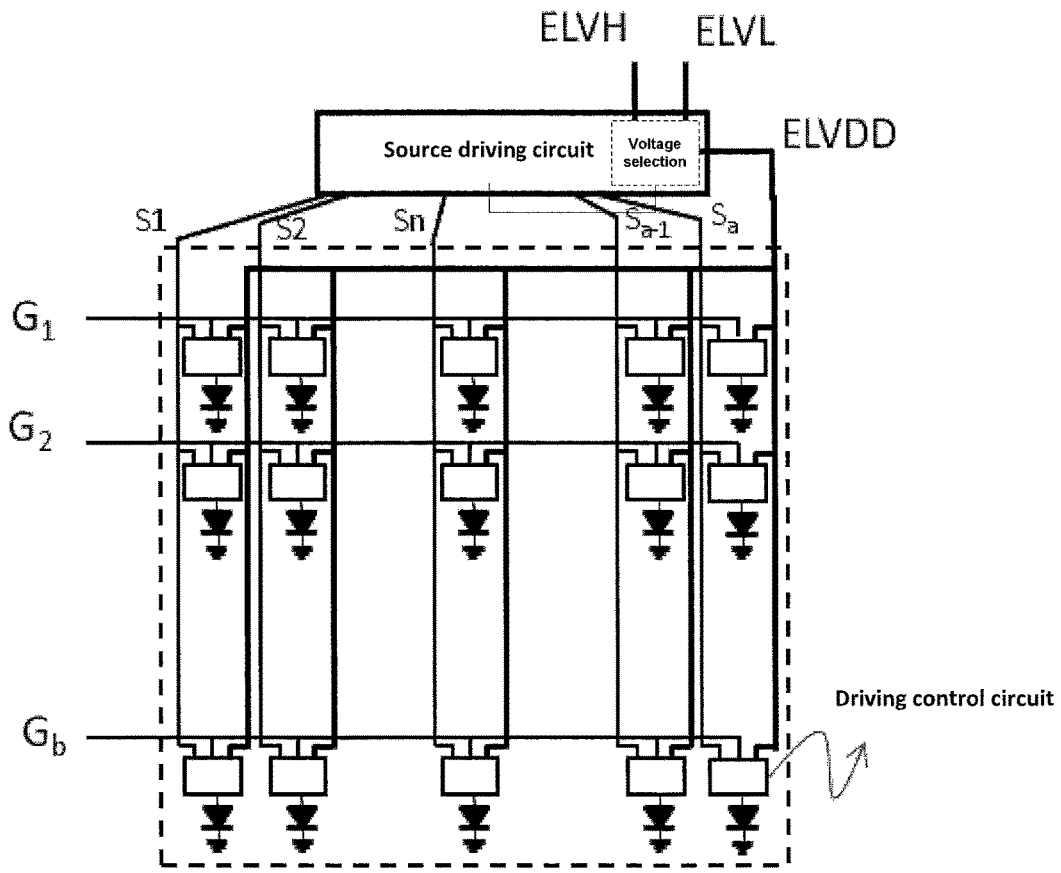
FIG. 10 illustrates a structural diagram of a display apparatus according to another embodiment of the present disclosure.

According to an embodiment of the present disclosure, the voltage selector may also be integrated into the source driving circuit. FIG. 10 illustrates a structural diagram of a display apparatus according to another embodiment of the present disclosure. In the display apparatus according to the embodiment of the present disclosure, the source driving circuit receives a high level power supply signal and a low level power supply signal, selectively outputs one of the high level power supply signal and the low level power supply signal to the driving element during scanning of each row, wherein the high level power supply signal drives the light-emitting element to emit light, and the low level power supply signal cannot drive the light-emitting element to emit light.

In the above-described embodiment, the density of the driving current can be adjusted by adjusting the driving voltage provided in the light emission phase of the light-emitting element, thereby improving the display quality.

Figure 11:
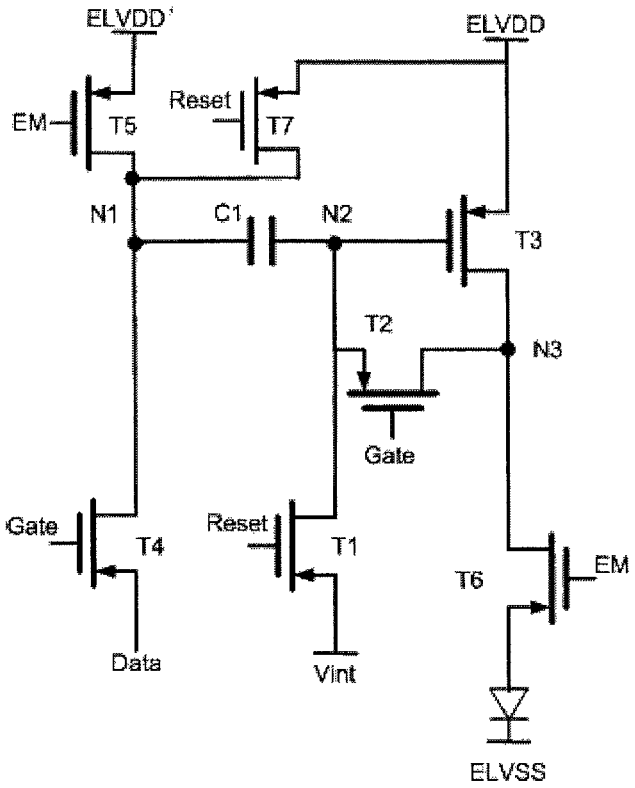
FIG. 11 illustrates a structural diagram of a display apparatus of an 8.4-inch flat panel.
Figure 12:
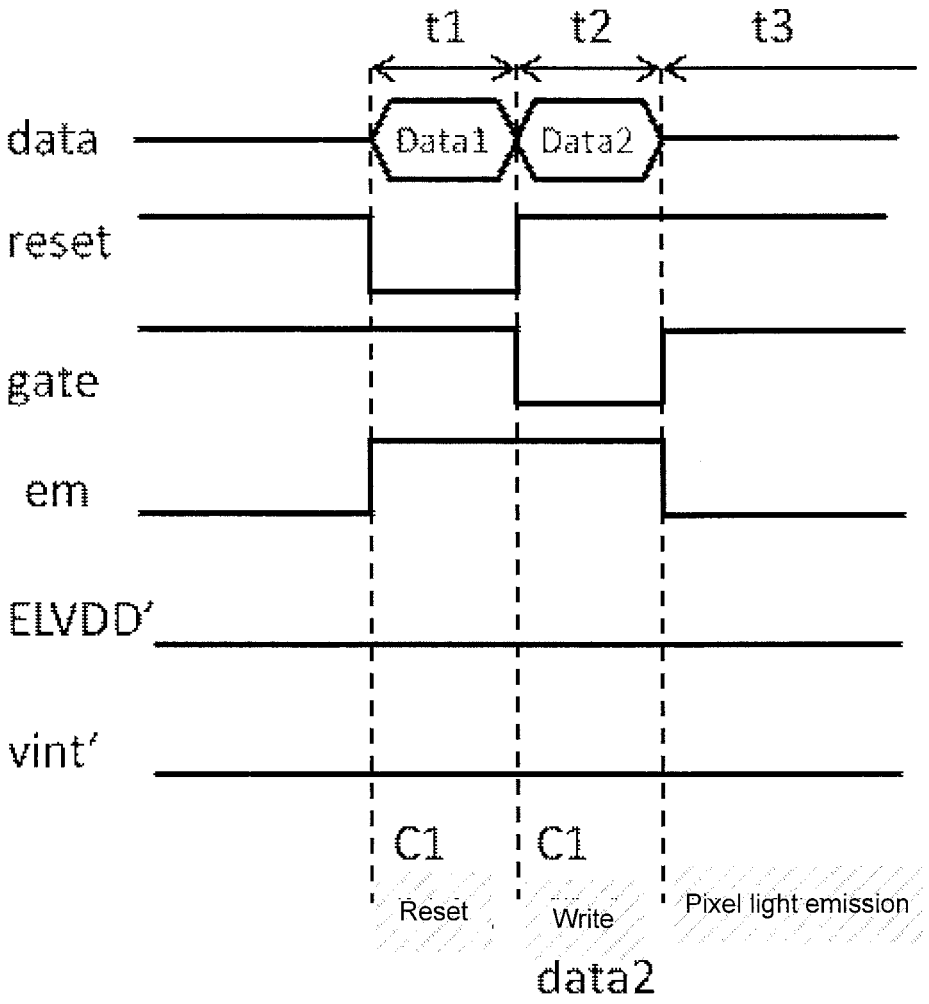
FIG. 12 illustrates an operation timing diagram of a driving apparatus in the display apparatus shown in FIG. 11.

FIG. 11 illustrates a structural diagram of a display apparatus of an 8.4-inch flat panel. FIG. 12 illustrates an operation timing diagram of a driving apparatus in the display apparatus shown in FIG. 11.

As shown in FIG. 12, an operation timing of the display apparatus shown in FIG. 11 is as follows:

1) During a reset phase t1, a driving control signal EM and a scanning signal Gate are at a high level, a transistor T5 and a transistor T6 are turned off, a transistor T3 and a transistor T4 are also turned off, a reset signal Reset is at a low level, and a capacitor C1 is reset through a transistor T7 And a transistor T1, that is, a voltage across the capacitor C1 is $ELV_{DD}$ and Vint, respectively.

2) During a data write phase t2, the driving control signal EM and the reset signal Reset are at a high level, T5, T6, T1 and T7 are turned off, the scanning signal Gate is at a low level, and T4 and T2 are turned on. As in the reset phase, a negative potential of Vint is written into a point N2 of the capacitor C1, and T3 is turned on, T3 writes a level of $ELV_{DD}$-$V_{th}$ into N2 through T2, while Data writes a data signal data into a point N1 of C1 through T4. The voltage across C1 is $ELV_{DD}$-$V_{th}$-$V_{data}$.

3) During a light emission phase t3, the reset signal Reset and the scanning signal Gate are all at a high level, T1, T7, T2 and T4 are turned off, and the driving control signal EM is at a low level. In this case, T5 and T6 are turned on, T3 is also turned on, a level of $ELV_{DD}'$ is clamped to the terminal N1 of C1 through T5, and a level at the point N2 becomes $ELV_{DD}'$+$ELV_{DD}$-$V_{th}$-$V_{data}$.

During a light emission phase t3, the driving current of T3 is $$I_D = \frac{1}{2}\mu_n C_{OX}\frac{W}{L}(ELV'_{DD} - V_{data})^2$$

wherein, a function of $ELV_{DD}'$ is to reduce the effects of a resistance voltage drop, and is used as a reference level.

It can be seen that the driving current has no relation to the voltage $ELV_{DD}$ of the power supply signal. Generally, $ELV_{DD}'$ is a single-level signal.

Figure 13:
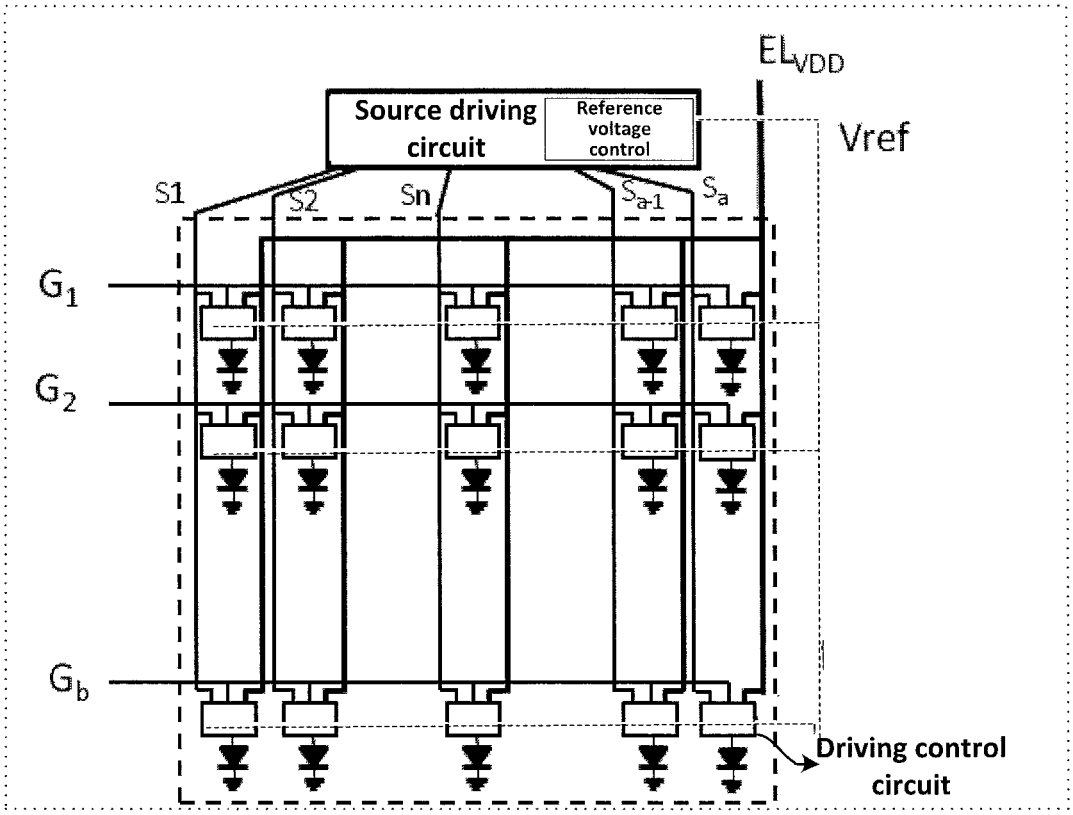
FIG. 13 is a structural diagram of a display apparatus according to an embodiment of the present disclosure.

FIG. 13 is a structural diagram of a display apparatus according to an embodiment of the present disclosure. As shown in FIG. 13, the driving apparatus of the display apparatus according to the embodiment of the present disclosure further comprises a reference voltage control circuit configured to generate a high level reference voltage and a low level reference voltage.

Specifically, the reference voltage control circuit of the driving apparatus according to the embodiment of the present disclosure is configured to generate a high level reference voltage and a low level reference voltage. The driving control circuit is configured to provide a high/low level signal to a control terminal of the driving element according to the reference voltage. A signal at one of the high level and the low level causes the driving element to be driven normally; and a signal at the other of the high level and the low level causes the driving element to be in a cut-off state or in a slight turn-on state.

The high level reference voltage and the low level reference voltage are generated by the reference voltage control circuit. Generally, voltage amplitude may be adjusted through programming.

Figure 14:
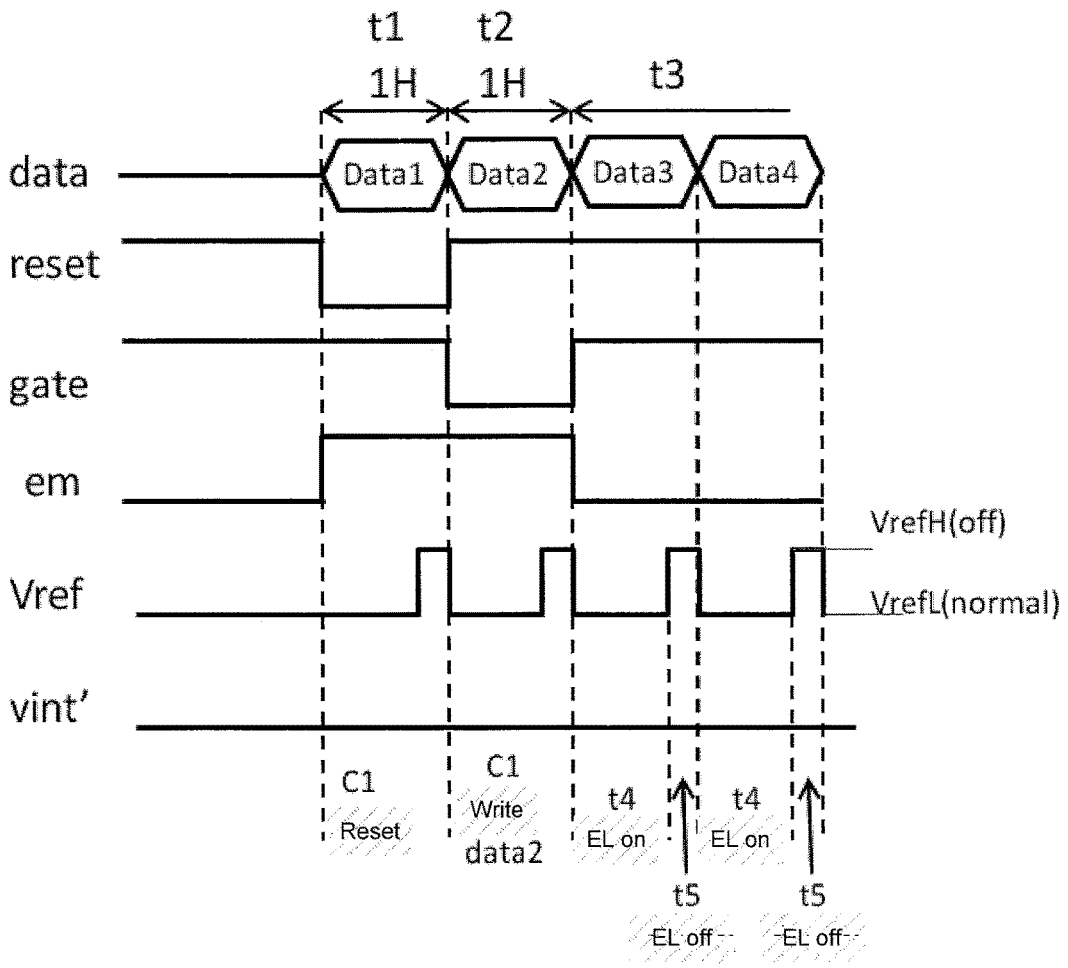
FIG. 14 is an operation timing diagram of a driving apparatus in a display apparatus according to an embodiment of the present disclosure.

FIG. 14 is an operation timing diagram of a driving apparatus in a display apparatus according to an embodiment of the present disclosure.

In combination with FIGS. 11, 13 and 14, an operation timing of the driving apparatus in the display apparatus shown in FIG. 13 is as follows:

1) During a reset phase t1, a driving control signal EM and a scanning signal Gate are at a high level, a transistor T5 and a transistor T6 are turned off, a transistor T3 and a transistor T4 are also turned off, a reset signal Reset is at a low level, and a capacitor C1 is reset through a transistor T7 and a transistor T1, that is, a voltage across the capacitor C1 is $ELV_{DD}$ and Vint, respectively.

2) During a data write phase t2, the driving control signal EM and the reset signal Reset are at a high level, T5, T6, T1 and T7 are turned off, the scanning signal Gate is at a low level, and T4 and T2 are turned on. As in the reset phase, a negative potential of Vint is written into a point N2 of the capacitor C1, and T3 is turned on, T3 writes a level of $ELV_{DD}$-$V_{th}$ into N2 through T2, while Data writes a data signal data into a point N1 of C1 through T4. The voltage across C1 is $ELV_{DD}$-$V_{th}$-$V_{data}$.

3) During a light emission phase t3, alternate light emission sub-phase t4 and non-light emission sub-phase t5 are included. The reset signal Reset and the scanning signal Gate are at a high level, T1, T7, T2 and T4 are turned off, and the driving control signal EM is at a low level. In this case, T5 and T6 are turned on, T3 is also turned on, a level of Vref is clamped to the terminal N1 of C1 through T5, and the level at the point N2 becomes Vref+$ELV_{DD}$-$V_{th}$-$V_{data}$. During a phase t4, Vref is a low level reference voltage VrefL, that is, a level which can control T3 to be turned on normally to cause the light-emitting element to emit light. During a phase t5, Vref becomes a high level reference voltage VrefH, and as the level of Vref increases, the level at the terminal N2 of C also increases, and thereby T3 is cut off and the light-emitting element does not emit light.

In this embodiment, the emission luminance of the light-emitting element, that is, the current density of the light-emitting element, can be adjusted by adjusting a duty ratio between VrefL and VrefH.

Figure 15:
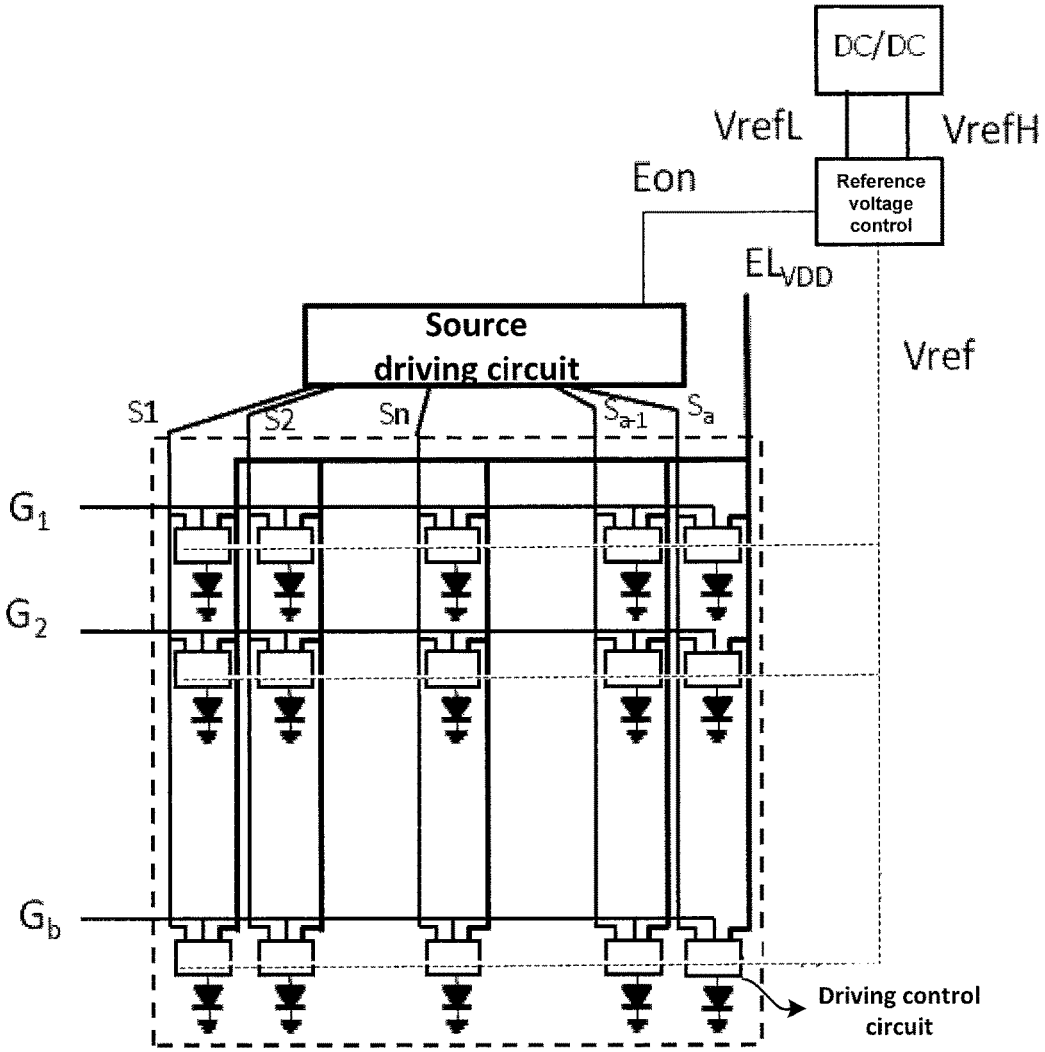
FIG. 15 illustrates a structural diagram of a display apparatus according to another embodiment of the present disclosure.

FIG. 15 illustrates a structural diagram of a display apparatus according to another embodiment of the present disclosure.

According to an embodiment of the present disclosure, a high level reference voltage and a low level reference voltage are generated by an external circuit. According to an embodiment of the present disclosure, the driving apparatus comprises a source driving circuit, a driving control circuit, a driving element, and a light-emitting element. The source driving circuit outputs a selection signal to a reference voltage control circuit which receives the high level reference voltage and the low level reference voltage, to cause the reference voltage control circuit to selectively output one of the high level reference voltage and the low level reference voltage, so that the driving control circuit provides a high level driving voltage and a low level driving voltage.

Figure 16:
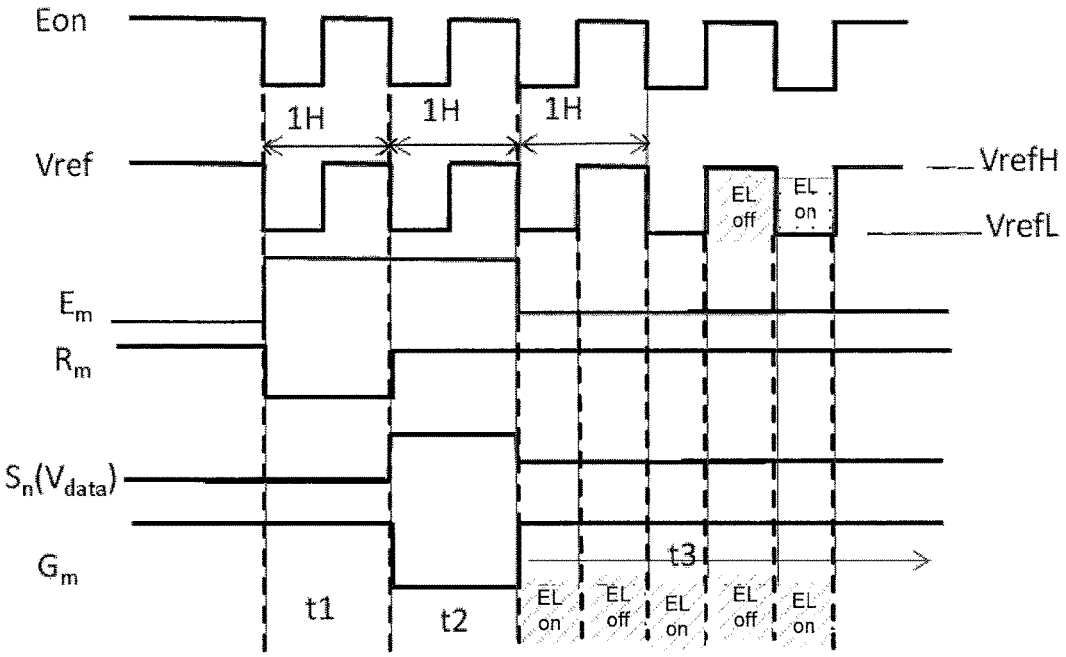
FIG. 16 illustrates an operation timing diagram of a driving apparatus in the display apparatus shown in FIG. 15.

FIG. 16 illustrates an operation timing diagram of a driving apparatus in the display apparatus shown in FIG. 15. The reference voltage selection circuit selectively outputs VrefH or VrefL according to a selection signal $E_{on}$ output by the source driving circuit.

Although the driving apparatus is shown in FIG. 6, the display apparatuses are shown in FIGS. 7, 10, 13, and 15, and the voltage selector is shown in FIG. 9, it will be apparent to those skilled in the art that these circuits and apparatuses may use other structures. For example, the driving apparatus according to the embodiment of the present disclosure may be applied to a display apparatus having another structure, and the voltage selector according to the embodiment of the present disclosure may be applied to a driving apparatus having another structure. These figures are shown by way of example only. For example, the structure of the voltage selector shown in FIG. 9 may not be limited to the illustrated structure.

Figure 17:
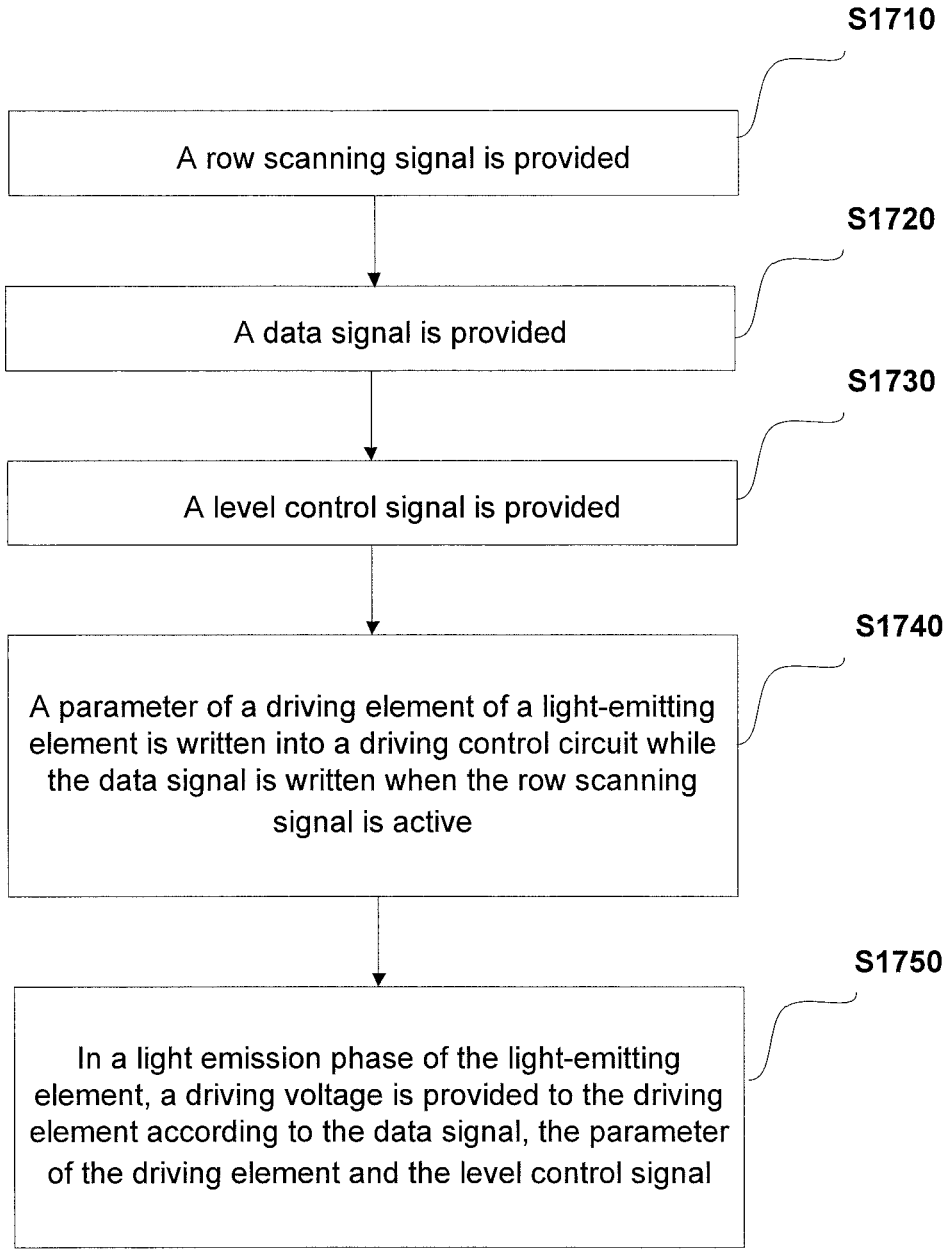
FIG. 17 illustrates a flowchart of a driving method for a driving apparatus according to an embodiment of the present disclosure.

FIG. 17 illustrates a flowchart of a driving method for a driving apparatus according to an embodiment of the present disclosure.

As shown in FIG. 17, the driving method for the driving apparatus according to an embodiment of the present disclosure comprises the following steps. In step S1710, a row scanning signal is provided on a row scanning line. In step S1720, a data signal is provided on a data line. In step S1730, a level control signal is provided. In step S1740, a parameter of a driving element for a light-emitting element is written into a driving control circuit while writing the data signal when the row scanning signal is valid. In step S1750, in a light emission phase of the light-emitting element, a driving voltage is provided to the driving element according to the data signal, the parameter of the driving element and the level control signal; wherein the level control signal is configured to comprise a high level and a low level, one of which causes the driving voltage not to be sufficient enough to drive the driving element, and the other of which causes the driving voltage to be provided to the driving element according to the data signal and the parameter of the driving element to cause the light-emitting element to emit light.

Steps S1710-S1730 may be performed in parallel. In other words, the row scanning line is connected to a row scanning signal source, the data line is connected to a data source, and a source of the level control signal is connected to a line of the level control signal in advance. Then, steps S1710-S1730 are performed so that the display apparatus enters a data write phase, i.e., the row scanning signal is valid while writing the data signal. In this case, in step S1740, the parameter of the driving element for the light-emitting element is written into the driving control circuit. Then, when the display apparatus enters the light-emission phase of the light-emitting element, in step S1750, the driving voltage is provided to the driving element according to the data signal, the parameter of the driving element, and the level control signal which have been written.

According to an embodiment of the present disclosure, the level control signal may be a power supply signal of the light-emitting element. That is, when the level control signal is at a high level, the driving control circuit provides the driving voltage to the driving element according to the data signal and the parameter of the driving element to drive the light-emitting element to emit light by the driving element; and when the level control signal is at a low level, the provided driving voltage is unable to drive the driving element and thereby the light-emitting element does not emit light.

According to an embodiment of the present disclosure, the level control signal may be applied to a control terminal of the driving element. The level control signal at one of a high level and a low level causes the driving element to be driven normally, and the level control signal at the other of the high level and the low level causes the driving element to be in a cut-off state or in a slight turn-on state.

According to an embodiment of the present disclosure, the level control signal is synchronous with the row scanning signal. That is, a gating time of the row scanning signal is the same as duration of the high level power supply signal so that the data signal is not written when the power supply signal is at a low level.

It should be noted that, in the foregoing description, the technical solutions of the present disclosure have been illustrated by way of example only, and are not intended to limit the present disclosure to the above-described steps and structures. Wherever possible, steps and structures can be adapted and selected as needed. Therefore, some steps and units are not elements necessary to implement the general inventive idea of the present disclosure. Accordingly, the requisite technical features of the present disclosure are limited only by the minimum requirements that can achieve the general inventive idea of the present disclosure, without being limited to the specific examples above.

The present disclosure has been described in combination with the preferable embodiments. It is to be understood that various other changes, substitutions and additions can be made by those skilled in the art without departing from the spirit and scope of the present disclosure. Accordingly, the scope of the present disclosure is not limited to the specific embodiments described above, but should be defined by the appended claims.

I claim:

1. A driving apparatus for driving a light-emitting element, comprising:

a source driving circuit configured to generate a row scanning signal required for driving the light-emitting element and a data signal, wherein the data signal is written into a driving control circuit for the light-emitting element when the row scanning signal is valid;

the driving control circuit configured to write a parameter of a driving element for the light-emitting element while writing the data signal when the row scanning signal is valid, wherein the driving control circuit is further configured to receive a level control signal and provide a driving voltage to the driving element according to the data signal, the parameter of the driving element and the level control signal in a light emission phase of the light-emitting element; and the driving element configured to convert the driving voltage provided by the driving control circuit into a driving current, and provide the driving current to the light-emitting element, so that the light-emitting element emits light under the driving of the driving current provided by the driving element;

wherein the level control signal is configured to comprise a high level and a low level, one of which causes the driving voltage not to be sufficient enough to drive the driving element, and the other of which causes the driving control circuit to provide the driving voltage to the driving element according to the data signal and the parameter of the driving element to cause the light-emitting element to emit light, wherein the driving apparatus further comprises a voltage selector configured to receive a selection signal, select a power supply signal at one of a high level and a low level according to the selection signal, and output the power supply signal selected to the driving control circuit as the level control signal, and wherein a duty ratio between the high level and the low level of the level control signal is adjustable.

2. The driving apparatus according to claim 1, wherein the level control signal is a power supply signal of the light-emitting element, wherein when the level control signal is at a high level, the driving control circuit provides the driving voltage to the driving element according to the data signal and the parameter of the driving element to drive the light-emitting element to emit light by the driving element, and when the level control signal is at a low level, the provided driving voltage is unable to drive the driving element and thereby the light-emitting element does not emit light.

3. The driving apparatus according to claim 2, wherein the voltage selector comprises a high level voltage power supply for outputting the high level power supply signal and a low level voltage power supply for outputting the low level power supply signal.

4. The driving apparatus according to claim 3, wherein one of the high level power supply signal and the low level power supply signal is set as a power supply signal for causing the light-emitting element to emit light normally, and when the other of the high level power supply signal and the low level power supply signal is set as a power supply signal and the power supply signal is applied, driving elements are all in a cut-off state under all the data signals.

5. The driving apparatus according to claim 3, wherein the selection signal is generated by the source driving circuit or an external circuit.

6. The driving apparatus according to claim 3, wherein the voltage selector is comprised in the source driving circuit.

7. The driving apparatus according to claim 1, wherein the level control signal is input to a control terminal of the driving element, wherein the level control signal at one of the high level and the low level causes the driving element to be driven normally, and the level control signal at the other of the high level and the low level causes the driving element to be in a cut-off state or in a slight turn-on state.

8. The driving apparatus according to claim 7, wherein the level control signal is generated by the source driving circuit or an external circuit.

9. The driving apparatus according to claim 1, wherein the level control signal is synchronous with the row scanning signal.

10. The driving apparatus according to claim 3, wherein the voltage selector comprises a first transistor having a gate configured to receive the selection signal of the driving voltage control circuit, a source configured to receive a high level power supply signal, and a drain connected to a gate of a second transistor; the second transistor having a source configured to receive the high level power supply signal, and a drain connected to an output terminal; a first resistor having one end connected to the gate of the second transistor and the other end connected to the ground; a third transistor having a gate connected to a source of a fourth transistor, a source configured to receive a low level power supply signal, and a drain connected to the output end; the fourth transistor having a gate configured to receive the selection signal of the driving voltage control circuit and a drain connected to the ground; and a second resistor having one end connected to the source of the third transistor and the other end connected to the gate of the third transistor.

11. A method for driving a light-emitting element applied in the driving apparatus according to claim 1, comprising:

providing a row scanning signal on a row scanning line;

providing a data signal on a data line;

providing a level control signal;

writing a parameter of a driving element of the light-emitting element into a driving control circuit while writing the data signal when the row scanning signal is valid; and providing a driving voltage to the driving element according to the data signal, the parameter of the driving element and the level control signal in a light emission phase of the light-emitting element;

wherein the level control signal is generated to comprise a high level power supply signal or a low level power supply signal according to a selection signal, one of the high level power supply signal and the low level power supply signal causes the driving voltage not to be sufficient enough to drive the driving element, and the other causes the driving voltage to be provided to the driving element according to the data signal and the parameter of the driving element to cause the light-emitting element to emit light.

12. The method according to claim 11, wherein the level control signal is a power supply signal of the light-emitting element.

13. The method according to claim 11, wherein the level control signal is applied to a control terminal of the driving element, wherein the level control signal at one of the high level and the low level causes the driving element to be driven normally, and the level control signal at the other of the high level and the low level causes the driving element to be in a cut-off state or in a slight turn-on state.

14. The method according to claim 11, wherein the level control signal is synchronous with the row scanning signal.

15. A display apparatus, comprising:

the driving apparatus according to claim 1; and light-emitting elements each configured to emit light according to the driving current provided by the driving apparatus.

16. The driving apparatus according to claim 2, wherein the level control signal is synchronous with the row scanning signal.

17. The driving apparatus according to claim 3, wherein the level control signal is synchronous with the row scanning signal.

18. The method according to claim 12, wherein the level control signal is synchronous with the row scanning signal.

19. The method according to claim 13, wherein the level control signal is synchronous with the row scanning signal.

* * * * *